United States Patent [19]

Howard, III et al.

[11] Patent Number: 4,979,548

[45] Date of Patent: Dec. 25, 1990

[54] GOLF BAG COVER

[75] Inventors: Loren W. Howard, III; Edwin L. Korkki, Jr., both of Longwood, Fla.

[73] Assignee: Rain Check, Inc., Longwood, Fla.

[21] Appl. No.: 480,033

[22] Filed: Feb. 14, 1990

[51] Int. Cl.[5] ..... A63B 57/00; A63B 55/00

[52] U.S. Cl. ..... 150/159; 206/315.4

[58] Field of Search ..... 150/159, 160; 206/315.4, 315.3

[56] References Cited

U.S. PATENT DOCUMENTS

| | | | |
|---|---|---|---|
| D. 256,293 | 8/1980 | Edwards | D3/37 |
| 1,254,669 | 1/1918 | Fovargue . | |
| 1,617,115 | 2/1927 | Hotze | 206/315.4 |
| 2,985,212 | 5/1961 | Dozier | 150/159 |
| 3,620,276 | 11/1971 | Taylor | 150/159 |
| 3,831,652 | 8/1974 | Hyden et al. | 150/160 |
| 3,913,648 | 10/1975 | Sessler | 150/159 |
| 3,938,570 | 2/1976 | Stewart | 150/160 |
| 3,977,451 | 8/1976 | Duba | 150/159 |
| 4,200,133 | 4/1980 | Whitlow | 150/159 |
| 4,234,025 | 11/1980 | Berge | 150/159 |
| 4,453,632 | 6/1984 | Clower | 206/315.4 |
| 4,498,579 | 2/1985 | Brick | 206/315.4 |
| 4,699,164 | 10/1987 | Pilney et al. | 135/16 |
| 4,752,004 | 6/1988 | Very | 206/315.4 |

FOREIGN PATENT DOCUMENTS

| | | | |
|---|---|---|---|
| 1397277 | 6/1975 | United Kingdom | 150/160 |

*Primary Examiner*—Sue A. Weaver

*Attorney, Agent, or Firm*—James H. Beusse

[57] ABSTRACT

A cover for preventing water from entering a golf bag while removing clubs therefrom comprises a tubular sleeve formed of a water impervious, flexible material. The sleeve has upper and lower openings with an elastic band extending around and integral with the lower opening, and an absorbent cloth collar fastened around the upper opening. The lower opening of the tubular sleeve is larger than the diameter of the golf bag. The elastic band of the lower opening effectively draws said lower opening into relatively tight contact with the outer surface of the golf bag. The length of the sleeve is such that at least a portion of said sleeve extends a sufficient distance from the golf bag to collapse the sleeve whereby the upper opening is positioned in substantially the same direction as the lower opening. The length of the sleeve is approximately the same as the golf bag.

4 Claims, 1 Drawing Sheet

GOLF BAG COVER

This invention relates to golf bag covers and, more particularly, to a cover for preventing water from entering a bag during rainy weather while allowing easy selection and removal of clubs from the bag.

BACKGROUND OF THE INVENTION

U.S. Pat. No. 4,200,133 discloses a golf bag cover comprising an elongated, tubular sleeve having a frustoconical configuration. The sleeve is fabricated of a non-self supporting, water impervious material including an access opening and a lower opening, with the lower opening having a greater circumference than the access opening. A first continuous elastic band has a smaller circumference than the access opening and is disposed around the access opening and enclosed within a tubular sleeve. A second continuous elastic band is of a smaller circumference than the lower opening and larger than the first band. The second band is enclosed by a portion of the sleeve so that when the lower opening is placed over a golf bag, the second band draws the sleeve about the bag. The sleeve extends upwardly over any clubs in the golf bag and folds over the clubs with the access opening directed downwardly. A disadvantage of this cover is that the circumference of the access opening is relatively small and is further constricted by the first elastic band making it difficult to retrieve the clubs from the bag through the sleeve. Another disadvantage of this cover is that the sleeve must be extended upwardly to allow removal of a club whereupon rain may enter the access opening and run down the inside surface of the sleeve and into the golf bag thus allowing the club grips to become wet and slippery.

SUMMARY OF THE INVENTION

A general object of the present invention is to provide a cover for minimizing water entry into a golf bag while removing and replacing clubs. It is a more specific object of the present invention to provide a golf bag cover which permits removal and replacement of clubs with minimum difficulty and which minimizes rain entry into the golf bag. In one form, the present invention comprises an elongated, tubular sleeve formed of a pliable, water impervious, clear material with upper and lower openings. A continuous elastic band extends around and is integral with the lower opening. The band had a relaxed circumference less than that of the lower opening. An absorbent cloth collar is attached around the upper opening and extends a predetermined distance along the inside and outside surfaces of the sleeve. The lower opening of the tubular sleeve is larger than the diameter of the golf bag. The elastic band effectively draws the lower opening into relatively tight contact with the outer surface of the golf bag when the cover is placed on the bag. The length of the sleeve is approximately the same as the length of the golf bag and at least a portion of the sleeve extends from the golf bag and any clubs therein a distance sufficient to collapse the sleeve whereby the upper opening is positioned to face in substantially the same direction as the lower opening and in approximately the same plane.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
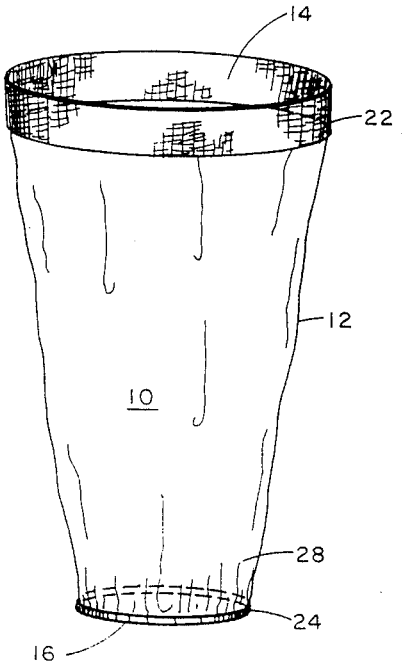
FIG. 1 is a perspective view of the golf bag cover of the present invention.
Figure 2:
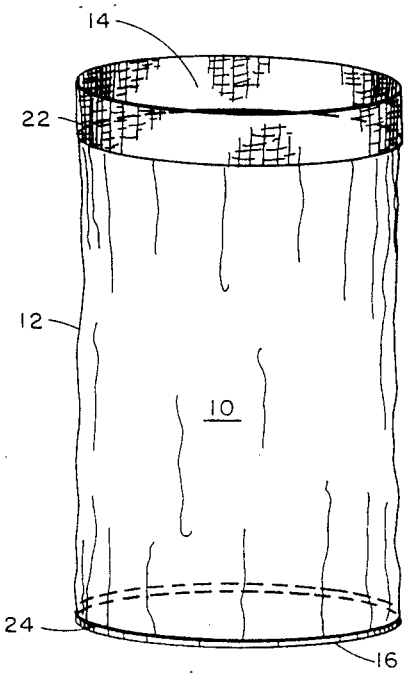
FIG. 2 illustrates the golf bag cover of FIG. 1 having both the elastic band and the cloth collar fully extended.

FIGS. 1–2 illustrate a golf bag cover 10 in accordance with the present invention which includes an elongated, tubular sleeve 12 of a preferably water impervious, transparent, plastic material. The plastic material should be sufficiently flexible to collapse under its own weight. The tubular sleeve 12 has an open top portion 14 and an open bottom portion 16. The diameter of open bottom portion 16, and thus the sleeve 12, is of a sufficient size to receive the upper mouth portion of a golf bag 18. An elastic band 24 is contained within an overlapping channel formed by the sleeve 12 at the lower opening 16. In an unflexed state, band 24 should have a length less than the circumference of the external surface of the mouth portion 26 of the golf bag 18 in order for the band 24 to maintain the device 10 on the golf bag. Elastic band 24 is capable of maintaining the lower portion of device 10 in a pleated form 28. An absorbent cloth collar 22 encompasses the upper opening 14, and is fixedly attached to the outermost edge of opening 14. The cloth collar 22 is preferably a material such as terry cloth which has relatively high absorbency. The collar 22 is folded over the edge of the sleeve about the opening 14 such that approximately equal extends of the material lie along the inside and outside surfaces of sleeve 12. The collar 22 is preferably sewn to the sleeve 12 although other forms of attachment, such as an adhesive, could be used. In one form, the collar 22 extends about 3.5 inches along the surfaces of the sleeve. The sleeve 12 may be about forty inches in length.

Figure 3:
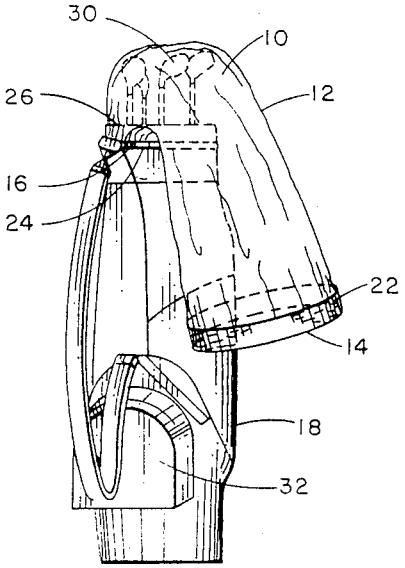
FIG. 3 is a perspective view of the present invention mounted on a bag of clubs.

FIG. 3 illustrates the present invention 10 mounted on a golf bag 18. The elastic band 24, in the lower opening 16, engages the device 10 around the mouth 26 of golf bag 18 so that in a normal state, the device 10 extends upwardly from the mouth 26 and overlies the heads of golf clubs 30. The upper opening 14 is weighted down by the absorbent cloth collar 22, and folds over the clubs 30 directing the opening 14 downwardly in substantially the same direction as opening 16 such that it lies in the same or lower plane than opening 16. Rain hitting the cover 10 will merely run down the cover 10 along its outside surface with some portion being absorbed by the cloth collar 18 surrounding opening 14. The weight of cloth collar 22 closes the opening 14 and prevents rain from splashing inside the sleeve 12.

Figure 4:
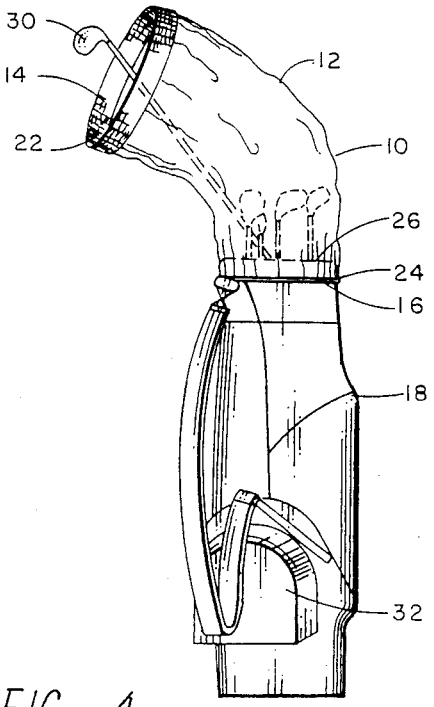
FIG. 4 is a view of the device of FIG. 3 illustrating withdrawal of a club from the golf bag when the bag is in a vertical position.

Removal of a golf club 30 from bag 18 is shown in FIG. 4. A club 30 is removed by reaching into the sleeve 12 through opening 14. The large diameter of opening 14 (and sleeve 12) allows the club to be withdrawn without extending the sleeve upwardly to an extent which would allow rain to directly enter the sleeve. Raindrops striking the perimeter of opening 14 are absorbed by collar 22 so that water is generally prevented from entering the sleeve 12 or from running into the bag 18 along the inside surface of sleeve 12. As will be apparent, the use of a transparent plastic material for sleeve 12 allows a club to be selected or located without looking through opening 14. A player can therefore reach a club through sleeve 12 without expanding opening 14. The uniform diameter allows clubs to be removed or replaced during normal use of the present invention without exposing the opening 14 to a vertical or near vertical position which would allow rain to enter bag 18. The collar 22 absorbs water around the opening 14 and prevents its entry into bag 18.

When not in use, the flexible cover 10 may be folded to a compact position and stored in the storage pocket 32, for example, usually located on the outside of the golf bag. Alternatively, as will be obvious to those skilled in the art, the cover may be compactly folded and placed in a coat pocket, or the like.

Accordingly, a simple and functional golf bag cover has been described herein. The cover of the present invention is removably attachable to the mouth of a golf bag and serves as a means of protection for the clubs contained therein during inclement weather conditions. Furthermore, this cover comprises a tubular sleeve having an elastic band surrounding a lower opening and an absorbent cloth collar surrounding an upper opening. The cover of the preferred embodiment is constructed from a flexible, transparent, plastic material so that when the cover is mounted on the golf bag, the upper portion will lie over the golf club heads while the upper opening is normally directed downward. In this manner, rain striking the cover will not enter the bag. Instead, the water will run down the external surface of the cover and be absorbed by the cloth collar.

While the invention has been described in what is presently considered to be a preferred embodiment, other variations and modifications will become apparent to those having ordinary skill in the art. Accordingly, it is intended that the invention not be limited to the specific embodiment but be interpreted within the full spirit and scope of the appended claims.

What is claimed is:

1. A cover for preventing water entry into a golf bag while removing clubs therefrom, said cover comprising:

an elongated, tubular sleeve formed of a pliable, water impervious material and having upper and lower openings;

a continuous elastic band extending around and integral with said lower opening, said band having a relaxed circumference less than that of said lower opening; and an absorbent cloth collar attached around said upper opening, said collar extending a predetermined distance along inside and outside surfaces of said sleeve.

2. The cover of claim 1 wherein the lower opening of said tubular sleeve is larger than the diameter of the golf bag and the relaxed circumference of said band is less than an outer circumference of the golf bag, said elastic band being effective to draw said lower opening into relatively tight contact with an outer surface of the golf bag when said cover is placed on the bag.

3. The over of claim 2 wherein the length of said sleeve is such that at least a portion of said sleeve extends from the golf bag a distance sufficient to collapse said sleeve whereby said upper opening is positioned in substantially the same direction as said lower opening.

4. The cover of claim 3 wherein the length of said sleeve is approximately the same length as a golf bag.

* * * * *